United States Patent [19]

Stutsman

[11] Patent Number: 4,884,212

[45] Date of Patent: Nov. 28, 1989

[54] APPARATUS AND METHOD FOR USING UNIQUE CHARGE CARDS DISPENSED FROM A VENDING MACHINE

[75] Inventor: Richard Stutsman, San Diego, Calif.

[73] Assignee: Vertx Corporation, Salt Lake City, Utah

[21] Appl. No.: 55,908

[22] Filed: May 29, 1987

Related U.S. Application Data

[63] Continuation-in-part of Ser. No. 29,618, Mar. 23, 1987, abandoned.

[51] Int. Cl.[4] ..... G07F 7/10; G07F 11/02

[52] U.S. Cl. ..... 364/479; 221/5; 221/66; 221/88; 194/205

[58] Field of Search ..... 364/479; 235/380, 381, 235/379, 462; 221/13, 88, 81, 155; 194/205, 210, 213, 217

[56] References Cited

U.S. PATENT DOCUMENTS

| | | | |
|---|---|---|---|
| Re. 28,701 | 1/1976 | Edward et al. | 235/381 |
| 3,935,933 | 2/1976 | Tanaka et al. | 194/210 |
| 3,984,660 | 10/1976 | Oka et al. | 235/384 |
| 4,300,040 | 11/1981 | Gould et al. | 235/381 |
| 4,598,810 | 7/1986 | Shore et al. | 221/88 |
| 4,650,977 | 3/1987 | Couch | 235/379 |
| 4,669,596 | 6/1987 | Capers et al. | 194/210 |
| 4,677,565 | 6/1987 | Ogaki et al. | 364/479 |

FOREIGN PATENT DOCUMENTS

| | | | |
|---|---|---|---|
| 8602758 | 5/1986 | European Pat. Off. | 221/88 |
| 8604173 | 7/1986 | European Pat. Off. | 194/205 |
| 0205691 | 12/1986 | European Pat. Off. . | |
| 2143661 | 2/1985 | United Kingdom . | |
| 2172731 | 9/1986 | United Kingdom . | |

*Primary Examiner*—Joseph Ruggiero
*Assistant Examiner*—Paul Gordon
*Attorney, Agent, or Firm*—Pretty, Schroeder, Brueggemann & Clark

[57] ABSTRACT

A dispensing machine is accessed repeatedly by a card issued by the machine. The machine comprises storage bins for holding and dispensing a plurality of products. A memory unit is included for storing information including representations of credit information, customer identification code information and product location information. A computer processor accesses information in the memory unit and enters information into the memory unit. A credit card reader responds to information from a credit card used by a customer for transferring credit for the customer to the computer processor for storage in the memory unit. A key pad is used by the customer for inputting credit amount to the computer procoessor. A customer card dispenser responds to the computer processor to dispense a customer card. The customer card can be read by a customer card reader in the machine coupled to the computer processor for obtaining representations of information from the customer card and for communicating them to the computer processor.

16 Claims, 6 Drawing Sheets

APPARATUS AND METHOD FOR USING UNIQUE CHARGE CARDS DISPENSED FROM A VENDING MACHINE

CROSS-REFERENCE TO RELATED APPLICATION

This is a continuation-in-part of the application entitled Apparatus and Method for Using Unique Charge Cards Dispensed From A Vending Machine, Ser. No. 029,618, filed Mar. 23, 1987, now abandoned.

BACKGROUND OF THE INVENTION

1. Field Of The Invention

The present invention relates to product dispensing apparatus such as video tape dispensing machines and more specifically to an apparatus incorporating a unique customer card dispenser for use with the same and corresponding apparatus.

2. Related Art

Product dispensing machines are well known and include such vending machines as cigarette and candy machines. These machines are typically mechanical or electromechanical machines. Such machines accepted valid currency and provided change if necessary, before the customer made a selection. The selected product was typically shunted to a bin in the machine for removal by the customer or a door closing the compartment in which the selected product is stored is released so that the customer can reach within and remove the product. Such machines typically dispense products of small value because of the limited capability of the machine to accept large currency or provide adequate change. Furthermore, such apparatus did not provide for return of the product since the product was typically not reusable There are also dispensing machines presently in use which accept a credit card or other substitute form of currency in order to dispense products or services. Such machines include long distance telephones, gasoline pumps, bank automatic teller machines, and other apparatus. At least in the case of the long distance telephone and the automatic teller machine, a key pad is used to enter one of a multitude of commands or data. A display on the apparatus communicates messages to the customer. In the case of automatic teller machines, a printer or other hard copy device issues a receipt acknowledging the transaction. Automatic teller machines also have an input slot for making deposits, after which a receipt is printed and issued. The request for making the deposit and the amount of the deposit is entered on a key pad. With these machines, access is usually made to a remote data base such as the bank or telephone accounting system. Credits or debits are applied either simultaneously with a transaction or in batch form.

With the above described machines, no provision is made for purchasing product having a large dollar value. Except with automatic teller machines, no means are provided for returning the same product to the machine. With automatic teller machines, the cash may be returned to the machine only after enclosing in an envelope for that purpose, but the cash was not dispensed in the envelope. Before the cash can be redispensed, the return envelope must be checked for the correct quantity of cash and the cash replaced in the bill output feeder for redispensing from the machine. The prior devices credit card, and requires that the machine go on line to access the data base in order to verify certain information, such as account balance, previous transactions in the last 24 hour period and amount of withdrawals in last 24 hour period.

SUMMARY OF THE INVENTION

A dispensing machine for dispensing reusable product is accessed repeatedly by a card issued by the machine. The machine comprises storage means for holding and dispensing a plurality of products. Memory means are provided for storing information including representations of credit amount information and product location information. Processing means access information in the memory means and enter information in the memory means. Credit input means in the machine is responsive to information from a customer for transferring credit for the customer to the processing means for storage in the memory means. Character entry means is responsive to actuation by a customer for producing representations of credit amount information desired by the customer and communicates the credit amount information representations to the processing means. Customer card dispensing means responds to the processing means for dispensing a customer card. Customer card reading means coupled to the processing means obtains representations of information from the customer card and communicates the representations to the processing means.

The disclosed apparatus is particularly suited to dispensing for purposes of rental or purchase of video tapes. However, it should be understood that the dispensing apparatus is also useful for dispensing other products. Furthermore, the customer card is suitable for use in conjunction with other apparatus. The apparatus is useful for dispensing video tapes because video tapes are products having a substantial value both in terms of rental and sale. Use of currency for rental or purchase of the video tapes would be inconvenient for the purchaser and inefficient for the operation of the machine. The use of personal credit cards would be inconvenient because of the larger amount of information that would need to be stored in the machine in order to properly track transactions. Additionally, it would be difficult to track the different modes of account numbering on multiple types of personal credit cards. With the machine described, a unique customer card is issued to the customer after an appropriate credit balance has been established in an account for the customer's use in conjunction with the issued customer card. The customer card is then used only on the machine which issued the card and a one-to-one correspondence is maintained between the card number and the customer account information stored in the information storage means. As a result, only a minimum amount of information needs be stored on the customer card, while data regarding the products, the customer card and the customer account are maintained in the storage means. Access to remote data bases is not necessary except on regular intervals. These intervals can be scheduled to occur during off-peak telephone access times. Alternatively, the machine and customer card can be designed so that one customer card can be used in other like machines.

In the various forms of the invention, means may be provided for accepting currency in order for the customer to develop a credit account in the machine. A card reader may be provided for reading the customer's personal credit card also to develop a credit account. A modem and other communication means is used to gain access to any necessary off-site or remote data bases to develop the credit account. A key pad is used to enter appropriate account information and to make product selections. The key pad can also be used by an operator to enter inventory information and to obtain inventory and sales data from the machine.

BRIEF DESCRIPTIONS OF THE DRAWINGS

DETAILED DESCRIPTION OF THE PREFERRED EMBODIMENTS

Figure 1:
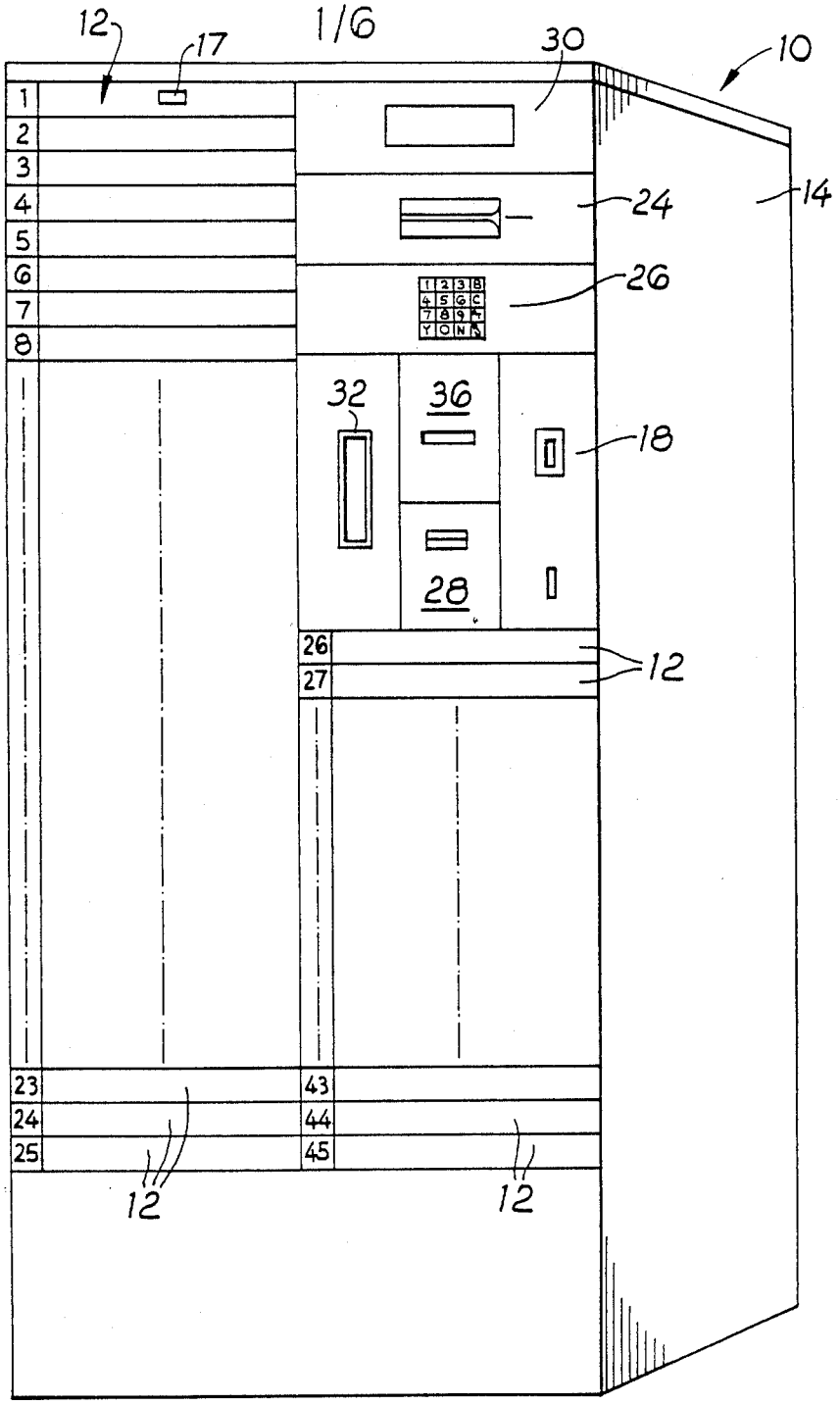
FIG. 1 is a schematic and partial perspective view of a front of a product dispensing machine.

A product dispensing machine 10 shown in FIG. 1 is for dispensing products selected by a customer. The machine is particularly suited to dispensing video tape cassettes or other products sold or rented in a like manner. Such a video tape cassette dispensing machine is shown and described in European patent publication number EP 0,205,691 A1. The apparatus to be described herein is particularly suited to a machine which will be used more than once by a given customer such as with the rental and return of video tape cassettes.

The machine is designed to be operation multiple times by a customer card issued by the machine. The card may be a credit card style card or other coded device capable of supplying representations of the encoded information on the card to the machine. Coded cards are well known today and are also used for gaining access to parking structures, secured buildings, etc. The card may have a magnetic strip for storing the coded unique formation. Such a card would be similar to standard personal credit cards and may have representations or other information embossed on the card and also stored on the magnetic strip. However, the card must be capable of distinguishing one customer from another and the machine must be able to accept a plurality of cards from as many different people.

Figure 2:
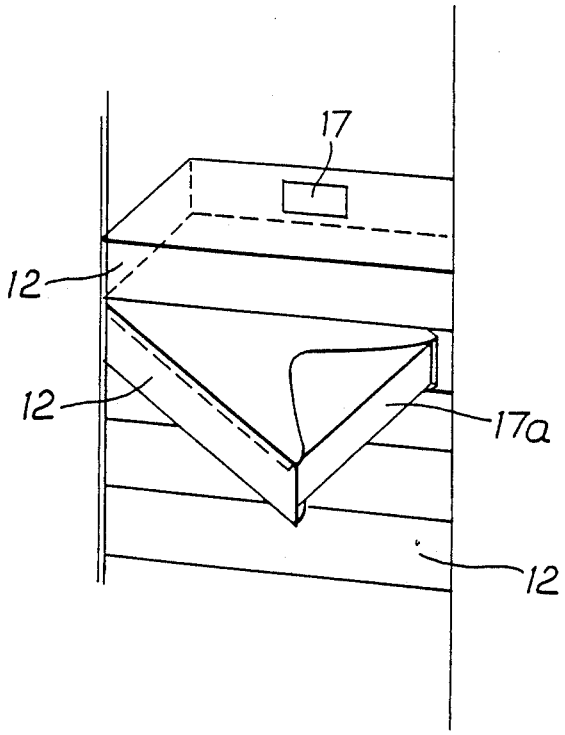
FIG. 2 is a schematic perspective view of several bins in the product dispensing machine shown in FIG. 1.

Bins 12 are provided in the chassis 14 of the dispensing machine for holding and dispensing a plurality of products (only one of which is shown in FIG. 2) wherein the products are held in a determinable configuration. In the type of arrangement shown in FIG. 1, each of the bins 12 will hold and be capable of dispensing only one respective product. In this configuration, there will be a direct correspondence between a bin and the product contained therein. For example, each bin will hold and will be capable of dispensing a respective video tape. (The discussion hereafter will be directed to video tape cassettes but it will be understood that the product is not to be limited to video tape cassettes.) Only one video tape cassette will fit into bin number one and bin number 1 will always thereafter correspond to the identified video tape cassette until that cassette is removed. Typically, each cassette will have a unique code, such as a bar code, to identify it. Once the particular cassette is stored in bin number one, bin number one will always correspond to that cassette and its code until the cassette is rented, and the cassette can be selected by identifying the bin number in which it currently can be found. Once the cassette is rented, the bin number will have no corresponding cassette number until a cassette is placed in the bin again. It will be clear that other logical arrangements can be used to store and allow dispensing of the video tapes.

Figure 3:
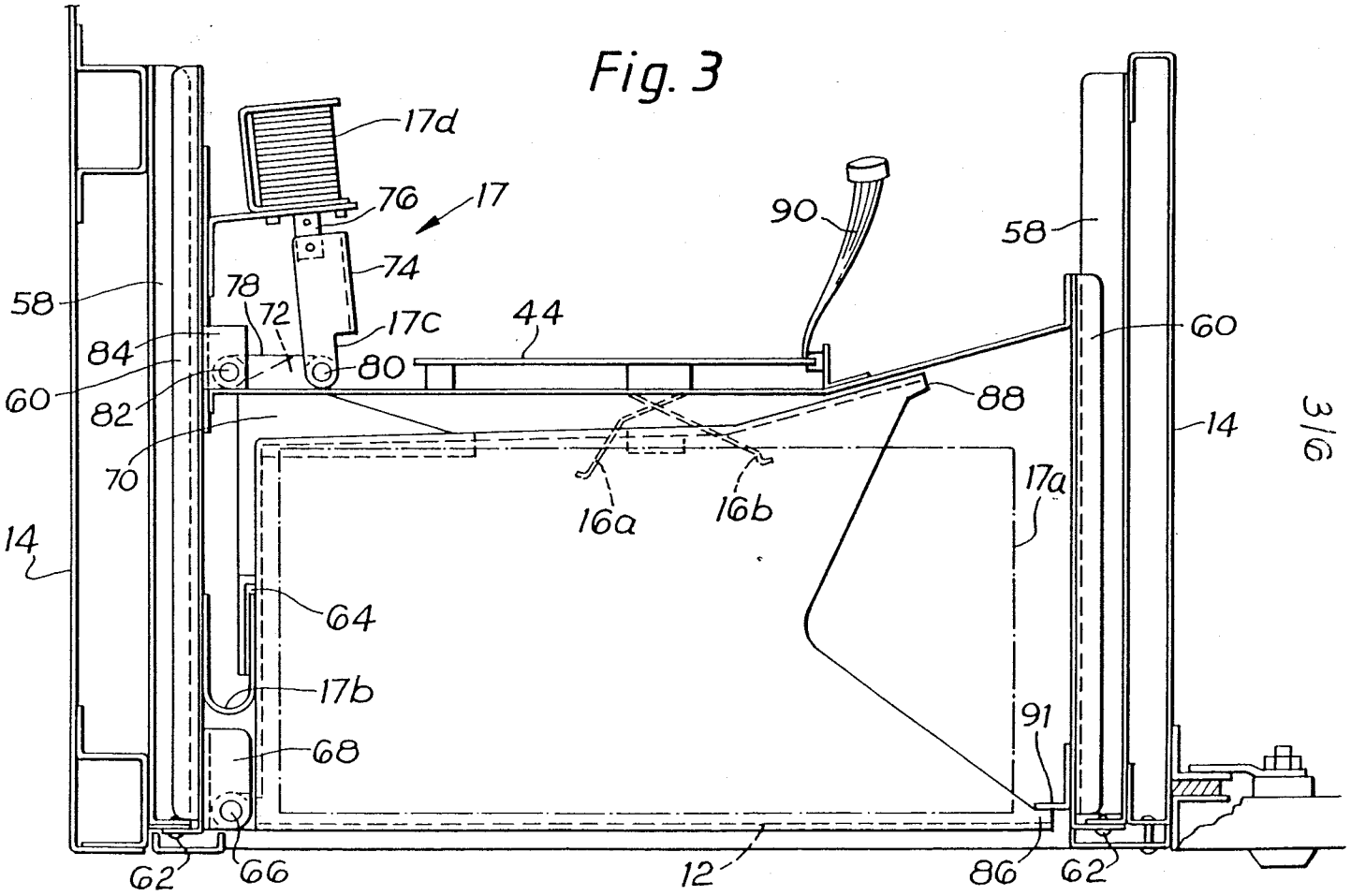
FIG. 3 is a schematic and top plan view of a bin and solenoid latch mechanism of the machine of FIG. 1.
Figure 4:
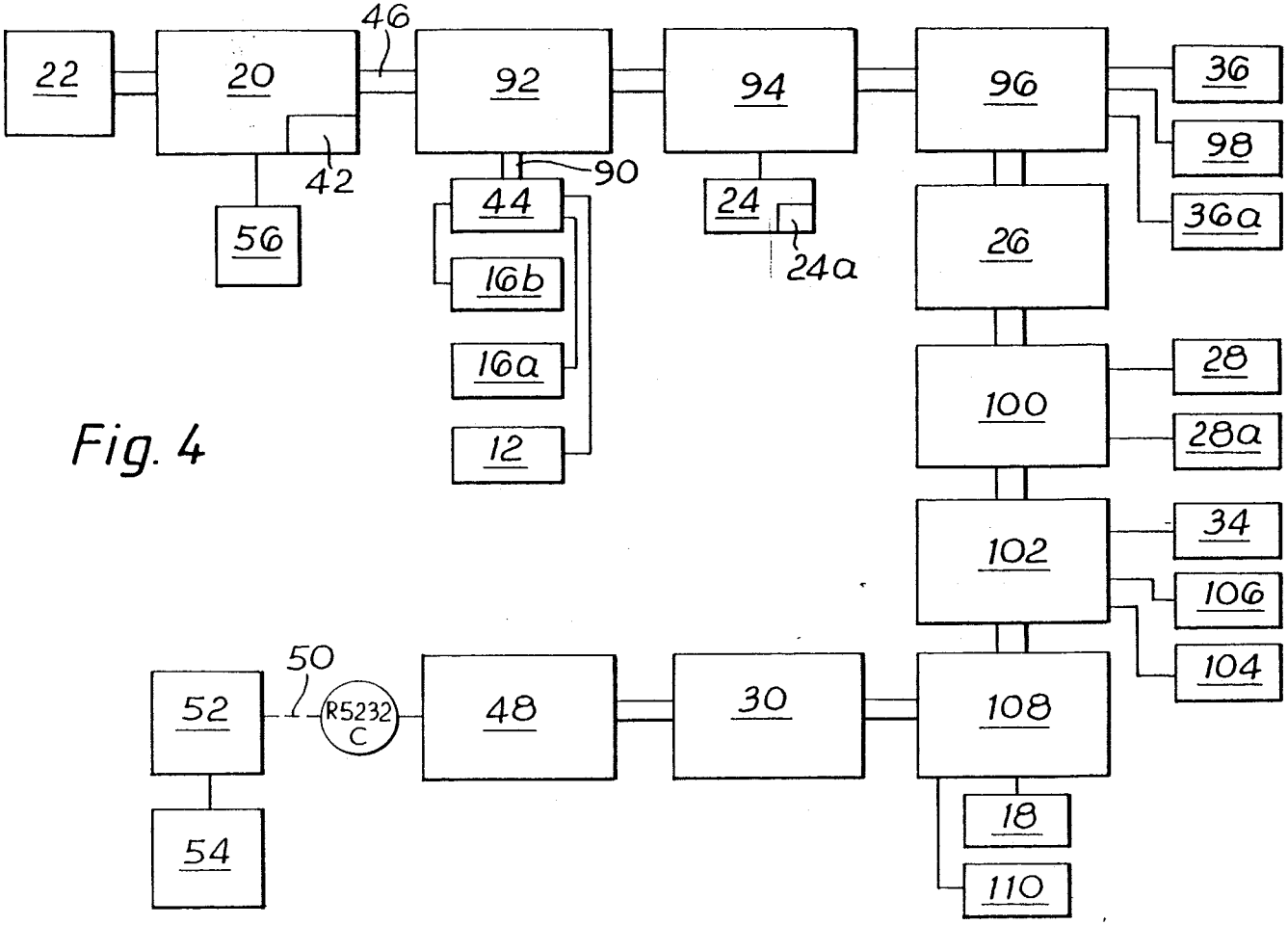
FIG. 4 is a schematic block diagram of the machine according to the present invention showing various electrical and mechanical elements used in carrying out the invention.

As shown in FIGS. 3 and 4, each bin has a respective bin sensor **16*a* for determining whether or not its bin is occupied. Also included in the term bin sensor are sensors 16*b*** for indicating whether or not the bin door is closed.

The number of bins in a given machine will vary according to the physical space available and the information storage space available in the machine. Additional bin units may be coupled to a single main machine and controlled by the controls in the main machine through signals carried over a bus or other communications means. The bins in a given machine are assembled in groups or modules of eight. As shown in FIG. 3, each module is suspended on shelves 58 in the chassis 14. There is one pair of shelves in the chassis for each module. Each module includes a corresponding pair of ledges 60 resting on the shelves. Each module is secured to the chassis through four module mounting screws 62, only two of which are shown in FIG. 3.

Each bin uses a solenoid and latch system 17 (shown schematically in FIG. 2 and described more fully below) to open the bin or to latch the bin closed. A clear plastic case **17*a*, such as one made from polycarbonate, holds the cassette firmly in place and oriented such that the video cassette can be inserted in the bin in only one way. The case will have sufficient space along its spine to view the cassette title and tape number. Each case will be formed so as to allow the code corresponding to the respective cassette to be read. The bin is biased open by a spring 17*b* (FIG. 3) when the latch 17*c* is released by the solenoid 17*d*. For each bin, the spring 17*b* is riveted (not shown) to the housing of the bin module. The opposite end of the spring is contained in a spring pocket 64 formed from the respective bin. Each bin rotates about a pocket pivot point 66 mounted to the bin module by a pivot support 68**.

At the corner of the bin on the side of the spring opposite the pivot point, the bin includes a flange portion 70 extending from the bin toward the solenoid **17*d*. The flange includes an ear 72 for engaging the latch mechanism 17*c* of the solenoid and latch system 17. The latch mechanism includes a release lever 74 rotatably linked to the armature 76 of the solenoid. The release lever extends from the armature toward the bin. The end of the release lever opposite the armature is rotatably coupled to a link arm 78 through a pin 80 extending through the release lever 74 and the link arm 78. The opposite end of the link arm is rotatably fixed to the module housing through a pin 82 passing through the link arms 78 and a bracket 84 on the module housing. The link arm is biased to rotate in a clockwise direction by a coil spring coiled around the pin 82 and the ends of which are coupled between the bracket 84 and the link arm 78. The biased link arm pulls the armature and the release lever 74 toward the bin, and therefore toward the ear 72**, when the solenoid is not energized.

Each bin includes a front lip 86 and a back lip 88 for contacting a stop 91 fixed to the right side (as seen in FIG. 3) of the module housing. The front lip 86 prevents further closer of the bin into the bin module and the back lip 88 prevents further opening of the bin after the bin has been opened a given amount through action of the spring **17*b* . The solenoid 17*d* is coupled to an appropriate circuit on the bin module controller printed circuit board 44 mounted to the rear of the module housing. (The conductors between the solenoid and the printed circuit board are not shown. ) Additionally, the sensor switch arms 16*a* and 16*b* are coupled to respective switches mounted to the printed circuit board 44 for determining, respectively, whether a tape 17*a* is present in the bin and whether the bin 12 is closed. The tape sensor switch 16*a*** senses the presence or absence of a tape through an opening in the bin through which the switch arm extends.

Each printed circuit board controls a solenoid and latch system **17*d* for each of the eight bins in a bin module and accepts signals from each sensor 16*a* and 16*b* corresponding to each bins of the eight. Control signals for the solenoids and information signals from the sensors are transmitted over a 16 conductor cable 90 to a main cabinet bin control printed circuit board 92 (FIG. 4). Each of the bin modules includes a bin module controller circuit board 44 and a 16 conductor cable 90 communicating information between the main cabinet bin controller 92 and the bin module controller 44** mounted behind each bin module.

The machine preferably includes two devices for transferring credit to an account in the machine for the customer. The first is a currency module 18 for accepting legal currency such as coin or bills. Coin mechanisms are well known in vending machines, such as the Mars Model 100, and bill readers such as dollar bill and five dollar bill readers are also well known. One example is the Rowe Model OBA. The currency module 18 may include one or both of these types of devices. The currency module monitors the amount of currency provided by the customer and communicates this information to a microprocessor 20 (FIG. 4) for processing and storage in a memory unit 22 used for storing information.

The second device for transferring credit is a card reader unit 24 for reading personal credit cards or other credit means and for communicating that information to the microprocessor 20. Typically, the card reader 24 is a magnetic strip card reader such as the Sanyo Seiki card reader well known in the art and may be similar to those used on automatic teller machines or on automatic credit authorization machines having a slot through which the magnetic strip is passed. The card reader reads the information from the credit card and transmits information regarding the card type and account number of the card holder over a seven or eight conductor cable to the microprocessor 20 for processing and storage. This information is used in conjunction with additional information provided by the customer through input on a key pad 26, allowing the customer to input the amount to be applied against the credit card account and credited to the account in the machine corresponding to that customer. The key pad 26 will also be useful for other purposes, as discussed more fully below.

In the preferred embodiment, the card reader 24 also reads the coded customer cards issued by the machine for each customer. For use in such a card reader, the customer card will have a magnetic strip containing the coded information. However, a separate card reading mechanism can be provided separate from the card reader 24 for reading the card to be supplied by the machine. The customer card may be similar to some types security access cards where the visible magnetic strip is omitted. The separate reader would be similar to card readers used with such security access cards, as is well known. Where the card reader is a motorized card reader, a sensor **24*a*** is used to sense the relative position of the card.

The key pad 26 is preferably a 16-key unit including the characters 0–9, a "yes" pad, a "no" pad, an "enter" pad, a "cancel" pad, a "rent" (RT) pad and a "return" (RN) pad. Alternatively, two of the non-numeric pads could be "up" and "down" arrow key pads. The number pads are used for entering amounts to be applied against the customer's credit card and added to the machine system to be used by the customer in renting or purchasing tapes. The number pads are also used to select bin numbers for removing video tapes as desired. The remaining pads are self-explanatory.

A printer 28 is provided in the machine 10 for outputting information from the microprocessor 20 in the form of a written receipt. The printer may be similar to the Fujitsu Model FTP020 20 column thermal printer. The printer is mounted behind the front panel of the machine. The printer 28 prints out such information as the transaction date, the starting and ending balance of the customer's account, the amount by which the customer's account is debited, the bin numbers or bar codes of the cassettes selected, etc. An "out-of-paper" sensor **28*a*** in the form of a micro-switch may be included.

A display unit 30 is mounted in the machine to provide messages and instructions from the microprocessor 20 to customers or to a technician monitoring the machine 10.

A tape slot 32 is provided in the front panel in the machine to accept individual video cassette tapes. The tape slot allows access to a bar code reader 34 (FIG. 4) for reading a bar code on a tape cassette being held by the customer. The bar code reader includes a scanning head 34 such as a Welch-Alyen Model CMM. The scanning head is mounted on a shaft operated by a motor, such as a Barber Colman motor CYQC 43200-31-5, to move the scanning head up and down. The scanning head reads the bar code on the inserted video cassette tape and communicates the bar code information to the microprocessor 20 for processing and storage.

A card dispenser 36 dispenses customer cards to customers for use in the machine from which the particular customer card is provided. As discussed above, the customer card can be in the form of a credit card or other coded device. Each card will be unique in that it contains a code unique to that card and which can be read by the card reader or other card "decoder" for obtaining the coded information from the card. The coded information will be on track two and consists of 29 numerals without separators. After the standard start sentinel of "%", the first four digits are an access code where 0000 has been allocated to the user, 0001 to the supervisor (e.g., store manager) and 0002 to an engineer or technician. The next field of five digits corresponds to the site number and is used where the customer card can access only the machine from which it was issued. The next field of five digits represent the card number, which also may be printed or embossed onto the card for identification purposes. The next field of nine digits are reserved for an expiration date. An additional field of five digits will contain the value of the credit entered into the customer's account when the card is initially issued. As discussed below, this value will be stored in the memory 22 (FIG. 4) against the card number the first time the card is presented to the machine. The last field of 1 digit indicates the number of tapes that are allowed to be rented at any one time. Alternatively, the last field of one digit can be disregarded in situations where the main central processing unit controller 20 has been previously configured to allow a predetermined number of cassette tapes to be rented at any one time. The field is terminated with the usual "?" end sentinel. The coded information is then communicated in the same form or in a translated form to the microprocessor 20 for processing and for storing in the memory unit 22. Preferably, each card in a given machine is pre-programed with specific information relating to the site code, the user access code (stored in the first four-digit field) the card identification number, and the card value. Information of lesser importance is the expiration date and the maximum number of tapes that can be rented during any one time.

Figure 8:
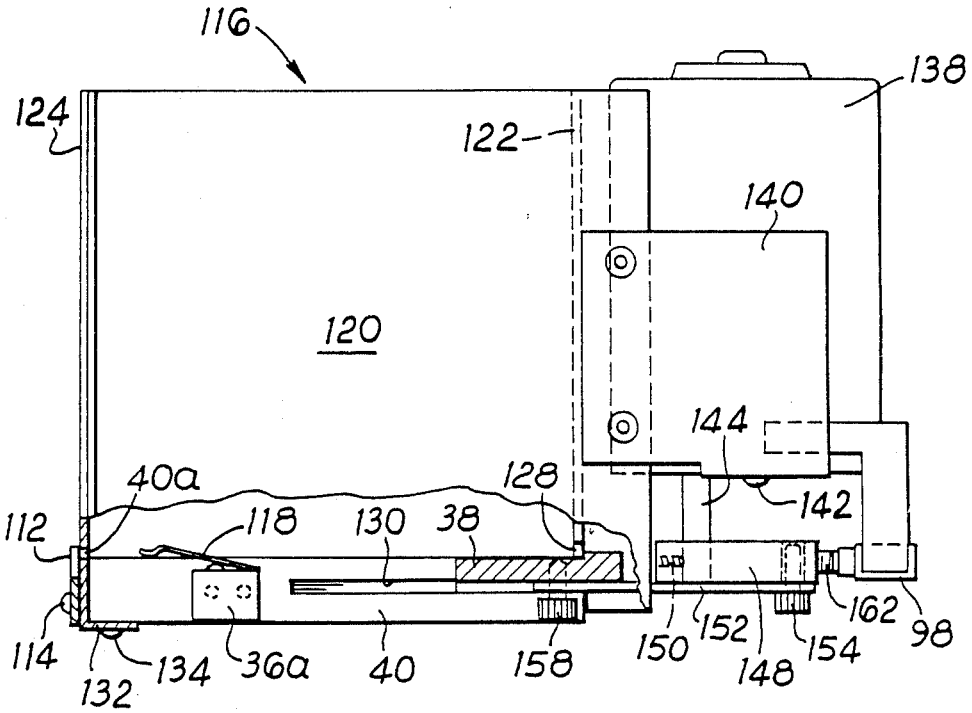
FIG. 8 is a schematic, partial cut-a-way and side elevation view of the card dispenser according to the present invention.
Figure 9:
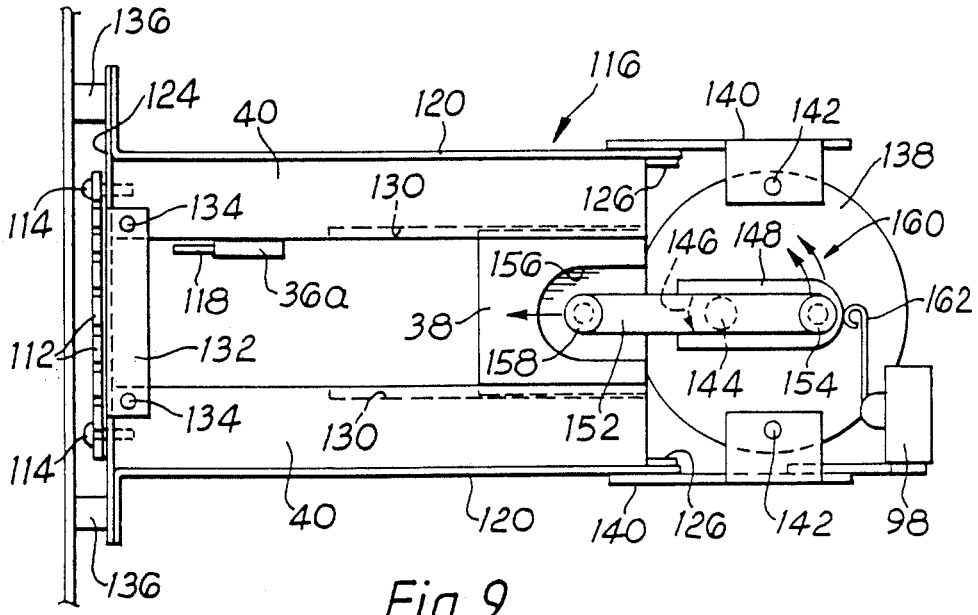
FIG. 9 is a schematic and bottom plan view of the customer card dispenser of FIG. 8 mounted to the front panel of the dispensing machine.

The card dispenser 36 may take various forms and would be similar in concept to card handling machines currently in use. Preferably, the card dispenser is a gravity fed device wherein the cards are stacked one on top of another. A weight may be applied to the top of the stack to insure that the stack shifts downwardly as each bottom card is dispensed. An "out-of-stock" or "card in place" sensor 36*a* may be included (FIGS. 4, 8 and 9).

Figure 5:
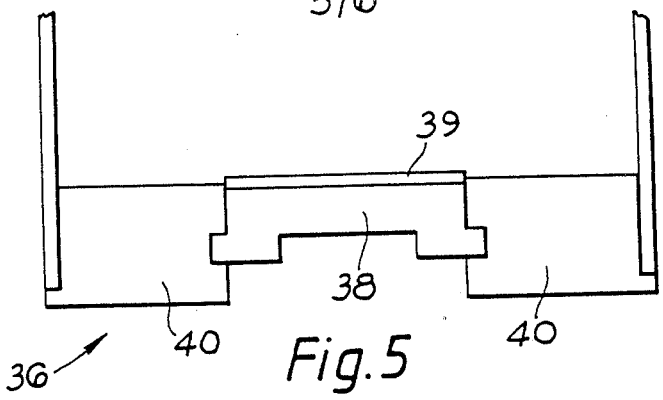
FIG. 5 is a schematic front elevation view of a customer card dispenser according to the present invention.

In the preferred embodiment (FIG. 5), the dispenser 36 includes a slide mechanism having a boss 39 extending the exposed width of the slide for engaging the back of the lowermost card. The slide travels in bearing plates 40 during forward and reverse travel. FIG. 5 shows a simplified version of the slide mechanism shown in more detail in FIGS. 8 and 9. The boss may extend 0.020 inch above the bottom of the bin, i.e., the top surfaces of the bearing plates, for contacting the lower two-thirds of the thickness of the card, where the card is 0.032 inch thick. Preferably, the top face of the slide below the boss is below the upper surfaces of the bearing plates. This arrangement minimizes any frictional force between a slide and the card as the slide returns to its rearmost position (see FIG. 8). This arrangement it also minimizes the possibility that the boss will contact the next card above the bottom card. The slide translates in a forward direction to dispense the card by pushing the card in front of it as it advances toward the front panel from the interior of the machine.

Figure 6:
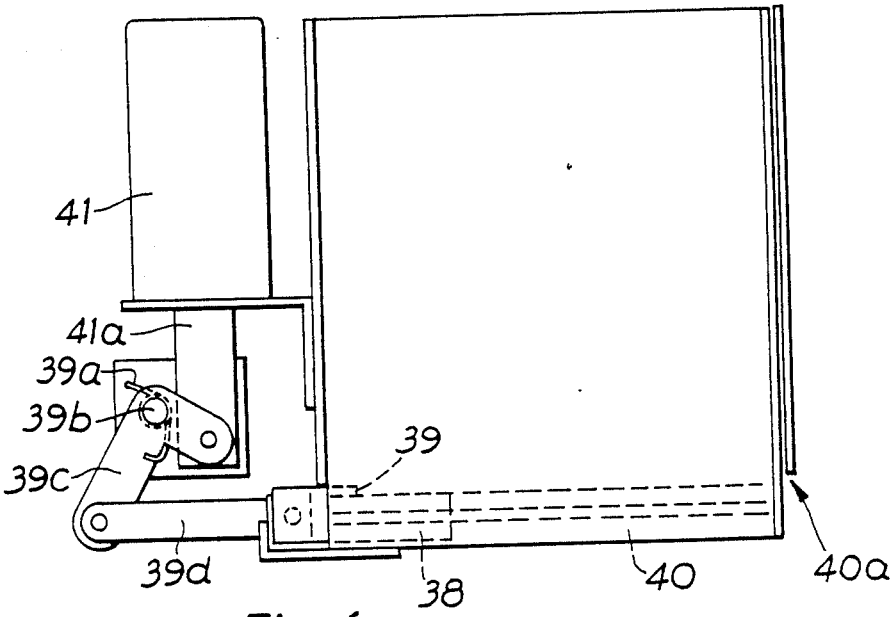
FIG. 6 is a schematic side elevation view of the customer card dispenser shown in FIG. 4.

Considering first the embodiment of the card dispenser shown in FIG. 6, the slide 38 is reciprocated forward and backward through the combined action of a solenoid 41 and a coil spring 39*a* coiled around the shaft 39*b* about which a pivot arm 39*c* rocks back and forth. Energization of the solenoid 41 lifts the armature 41*a*, thereby moving the pivot arm 39*c* counter-clockwise, as viewed in FIG. 6. The link arm 39*d* pushes the slide forward an amount determined by movement of the armature 41*a*. After the solenoid is deenergized and the slide 38 has reached its forward-most point of travel, the slide automatically returns to its static position by action of the spring 39*a*, thereby allowing the stack (not shown) to shift downward and present a new bottom card to the slide. Each card is dispensed through an opening 40*a* in the front of the dispenser. Since the slide does not travel all the way to the front of the card dispenser, the bottom most card will be pushed only part way through the opening. The customer then removes the card from the opening for use in the machine.

The memory unit 22 (FIG. 4) includes data and storage registers as would be known to one skilled in the art. Exemplary data files include housekeeping files, credit or ATM card files, transaction files and sales data files. The housekeeping file includes time and date information, a listing of all out-going telephone numbers used for gaining access to remote data bases such as those of credit companies, bank information centers or financial management companies. This file would also include price information for each bin, a list of credit or customer card numbers that will be refused service and product code number for each video cassette tape, including the bin number to which it is presently assigned and the status of that product code number. For example, the status may indicate "in stock", "out for rent", "sold" or "unreturned". The memory unit would also include information identifying the machine. The credit card or ATM card file would store customer credit card information such as the credit card number, the total value charged against the customer's personal credit card, the identification number of the customer card purchased using the credit card or using currency, the elapsed time since the last credit card verification, if applicable, the current credit balance for the customer's credit card and rental information insuring compliance with a two-tape rental limit at any one time. The card file also includes elapsed time information (for purposes of late charges for extended rental and to identify unreturned tapes) and the time when the tape is rented and when returned. The transaction file includes information such as the transaction time and date, the customer card number, the dollar amount of the transaction, the product identification code number of each product rented, sold or returned and the bank authorization number from the bank owning the card-holder's credit card. This data may be arranged and stored as would be known to one skilled in the art. The memory size of the memory unit will be determined by the maximum size of the machine desired, the amount of data to be stored and the length of time between updates on the machine.

It is in the memory unit 22 that there is a direct correspondence between a cassette in a bin and the number of that bin. The video cassette tape is returned to any available bin, in which case a new correspondence is developed between the video cassette tape and a bin number. The memory unit also stores information to allow the microprocessor 20 and its control logic 42 to monitor the last time at which the customer's bank card balance was checked, etc. There is also information relating to bin numbers stored in memory. Each bin number corresponds to a cassette number while a cassette is present. The cassette number is copied onto the credit customer card file when the customer selects a bin. There is also a file for cassette numbers to provide inventory and to store the present user and most recent user in order to detect fraudulent returns. These functions will be described more fully below.

The machine further includes the vend driver or bin module controller 44 for taking control signals off of a bus 46 from the microprocessor 20 in order to operate the bins and bin solenoids in the machine as previously described.

A modem 48 is provided to allow telecommunications over telephone lines 50 between the machine and a management company 52 which coordinates data from individual customers' personal credit cards. The management company 52 then coordinates with the respective banks 54 to debit or credit the respective customer's account after a predetermined time has elapsed (e.g. one month). The modem is also used to access these remote data bases in order to check the available credit for the customer identified by the customer's credit card. A power supply 56 is provided to operate the machine. The power supply may be a typical line voltage available from the facility in which the machine 10 is placed.

Each of the major components in the apparatus is controlled by the main central processing unit controller 20. Additionally, each of the major components operates through a respective digital logic control system on a printed circuit board. Each of the printed circuit boards are serially coupled together on a serial data transfer bus. This control system is based on the Mullard $I^2C$ design. The data transfer bus requires one line for data and one line for clocking, two lines for 24 volt DC power supply to each printed circuit board and a reset line which passes through the circuitry on each of the printed circuit boards. This allows each of the modules corresponding to the printed circuit boards to be initialized in sequence. Three additional lines are included for future expansion. Each of the printed circuit boards coupled to the data transfer bus includes its own microprocessor.

The printed circuit boards, not previously discussed, will now be described. The card reader controller PCB 94 accepts representations of the data, for example, the 29 characters of data, read from a customer card or a recognized credit card. These representations are obtained from the card reader assembly 24 and communicated to the main CPU controller 20 for processing.

The card dispenser controller printed circuit board 96, used in conjunction with the card dispenser of FIGS. 6, 8 and 9 controls the operation of the solenoid as a function of input from the main CPU controller. The card dispenser assembly 36 dispenses a customer card when the solenoid 41 (FIG. 6) is engergized by the card dispenser controller 96 upon receiving a coded signal from the main CPU controller 20 indicating that a customer's credit has been verified, an amount transferred to a customer's account in memory 22 and that a unique customer card should be dispensed to the customer. As discussed more fully below in conjunction with the embodiments of FIGS. 8 and 9, the card dispenser may include a motor position sensor 98 used to indicate the completion of a customer card dispensing operation.

The key pad typically includes its own printed circuit board for control and operation of the key pad. The key board printed circuit board is coupled in the data transfer bus along with the other printed circuit boards. A receipt printer printed circuit board 100 is also coupled in the data transfer bus and includes circuits which control the operation of the printer assembly 28 using information communicated to the printed circuit board 100 from the main central processing unit. The receipt printer circuit also accepts input from the "out of paper" sensor **28*a*** for indicating when the printer is out of paper and communicating that condition to the main CPU.

A bar code printed circuit board 102 also includes a circuit coupled to the data transfer bus for communicating representations of data from the bar code reader assembly 34 to the main CPU 20 over the data transfer bus 46. The microprocessor on the bar code printed circuit board 102 accepts input from a "bar code in place" sensor 104, which may be a momentary depression switch for indicating when the video tape cassette has been completely inserted into the bar code reader assembly. A scan position sensor 106 senses the position of the scanning head of the bar code reader so that the microprocessor can initiate scanning of the bar code by the scanning head and accept the representations of the bar code information read by the scanning head. Representations of the bar code are then transmitted to the main CPU over the data transfer bus 46.

A currency module 108 includes a circuit on a printed circuit board to control the currency module assembly 18 and which accepts input from a currency sensor 110 in order to determine the total amount of currency input to the currency module by the customer. This information is then communicated to the main CPU over the data transfer bus 46.

The message display 30 and modem 48 are also serially coupled to the data transfer bus 46.

Figure 7:
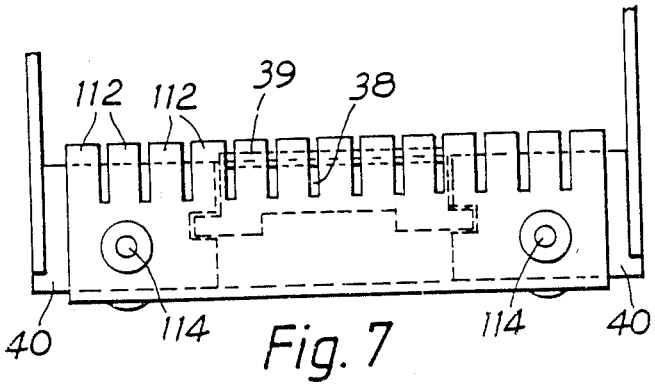
FIG. 7 is a schematic and partial front elevation view of part of the customer card dispenser shown in FIG. 5 including a customer card gate.

In a further embodiment of the invention, shown in FIG. 7, a plurality of dispenser fingers 112 are mounted to the front of the card dispenser through fasteners 114 set in the bearing plates 40. The dispenser fingers are preferably made from a spring metal and are sufficiently long to flex outwardly away from the card dispenser when a customer card presses against the fingers. The dispenser fingers provide a counter-force against the slide 38 allowing uniform movement of the customer card with the slide 38. The dispenser fingers also prevent reinsertion of a card after the slide has returned to its original position or after the card has been removed entirely from the card dispenser. In the former instance, reinsertion of a partially dispensed card is prevented by positive engagement of the ends of the fingers with the lower surface of the customer card. The dispenser fingers preferably extend over the slot **40*a*** through which each customer card is dispensed.

Considering FIGS. 8 and 9, an alternative embodiment of a card dispenser 116 includes the "card-in-place" sensor **36*a* in the form of a micro switch having a lever 118 which extends, when in its undepressed state, above the level of the bearing plates 40 where a customer card would ordinarily be. The card dispenser includes a pair of side plates 120, a back plate 122 and a front plate 124. The side, back and front plates define an enclosure in which the customer cards are stacked one on top of the other. The bottom-most customer card rests on the top surfaces of the bearing plates 40 in the bottom of the dispenser. The side plates extend from a point behind the ends of the bearing plates 40 to the front plate, where the side plates form flanges extending parallel to the front plate and flush therewith. The back plate includes flanges 126, flush with respective side plates to which the back plate is fastened. The back plate includes an opening 128 in the lower portion thereof to allow the ejector block 38 to slide in the groves 130 of the bearing plates 40. The grooves in the bearing plates extend only part of the entire length of the bearing plates. The relative dimensions of the ejector block and bearing plates are essentially the same as those described above with respect to FIG. 5. The bearing plates are fastened at their forward ends to a flange 132 through fasteners 134. The dispenser is mounted to the front plane of the machine through spacers 136**.

The ejector block is operated through a DC motor 138 mounted to the side plates through mounting brackets 140. The motor is fixed to the mounting brackets through fasteners 142. The motor is preferably a Barber Colman DC Motor, Model CYQC-43200-31-5. The drive shaft 144 is preferably offset from the center line of the motor. The drive shaft rotates in the direction indicated by the dashed arrow 146. The drive shaft 144 is coupled to the ejector block through a block 148 fixedly mounted to the drive shaft through a set screw 150. A link arm 152 is rotatably mounted to the radially outer-most end of the block relative to the drive shaft, through a screw 154. The link opposite end of the link arm is also rotatably mounted to the bottom of the ejector block, in a recessed portion 156 allowing the link arm to swing back and forth across the rear of the ejector block, through a second screw 158. Through this linkage, rotation of the drive shaft, as indicated in the direction of arrow 146 causes the block 148 and link arm 152 to move in the directions indicating by the arrows 160. This rotational motion will move the ejector block toward the front of the card dispenser. The motor position sensor 98 includes a contact arm 162 which is contacted by the radially outward end of the block 148 as the motor reaches the end of one cycle of rotation. The motor position sensor stops the DC motor to terminate the rotation of the motor and, therefore, the movement of the ejector block.

Three sets of two conductors each couple the card dispenser with the card dispenser controller printed circuit board. Two conductors couple the motor to the circuit on the printed circuit board, another to couple the "card-in-place" sensor 36*a* to the printed circuit board and the last to couple the motor position sensor 98 to the printed circuit board. In the preferred embodiments, the "card-in-place" sensor and the motor position sensors are micro-switches.

In operation, the customer will approach the machine and use a recognized personal credit card such as a Visa or Mastercard credit card, to initially gain access to the machine. The customer passes the coded information portion of the card through the card reader unit 24. The information is communicated in the identical form or in a decoded form to the microprocessor 20 where it is compared to data in the memory unit 22 in order to determine the type of card being used. If the card is a recognized personal credit card, such as a Visa or Mastercard, the machine will ask the customer several questions to define what the customer wants to do. If the card is a personal card, the customer will be asked if a customer card is to be purchased using the personal credit card. If not, purchases or rentals can be conducted according to the standard practice for using credit cards in such machines. Use of a personal credit card in the product dispensing machine is not the subject of this application.

If the customer elects to acquire a customer card, the customer enters the desired credit amount through the key pad 26. Typically, the requested credit amount may be $20 or more. Alternatively, the customer card will already have a minimum amount recorded onto the magnetic strip, in which case the customer will be asked whether a transfer of that amount from the customer's credit account is authorized. The microprocessor 20 enables the modem 48 to access the customer's credit account corresponding to the credit card the customer passed through the card reader 24 in order to verify the credit amount requested. If the requested credit amount is authorized by the credit card owner (database), a representation of the amount is stored in the memory unit 22 and decremented the necessary amount after each rental. The microprocessor also stores the credit card number in the memory unit (for later use in obtaining further credit authorization or for billing) and causes the card dispenser 36 to issue a customer card. The machine monitors and stores a representation of the customer card number in order to correlate the customer card with the customer's credit card number and the credit amount. The customer card can be monitored in several ways. One way is to read the information from the customer card as the customer card is issued from the card dispenser 36. This requires a reader in the dispenser. Another method is to maintain a sequential account of the customer cards issued where the number of the first customer card is entered into the memory unit by an operator before the first customer card is issued. The customer identification codes on the next subsequent card preferably differs from the first by one, or by some other incremental amount. The customer identification code already stored in a register in the memory unit is then incremented accordingly to arrive at the customer identification number of the next succeeding customer card. A third preferred way is to request the customer to pass the customer card through the card reader 24 so the machine can read the customer identification code. This is then processed by the microprocessor 20 and stored in the memory unit 22.

Once a customer card is obtained, the customer typically also wants to purchase or rent a videotape. The microprocessor then compares the credit amount to the value required for two rentals and to the value required to purchase a videotape cassette. If the amount is adequate to both rent and purchase, the customer is advised that he may rent or purchase tapes. If the customer indicates that a purchase is to be made, the microprocessor provides a display on the message display 30 requesting the customer to make a selection. The selection is made according to the same procedure as will be described below with respect to renting tapes. Once the customer enters a bin number corresponding to the tape to be purchased, the microprocessor produces a message on the message display 30 indicating the bin number, the price and asking if the customer wants to complete the purchase. If the customer affirms the purchase, the microprocessor 20 enters a representation in the memory unit 22 corresponding to the tape number or to the bin number, indicating that the corresponding tape has been purchased. The microprocessor also decrements the customer's credit amount by the purchase price of the tape and records the appropriate transaction data.

If the customer wants to rent tapes, the microprocessor 20 produces a message on the message display 30 requesting the customer to enter the bin number corresponding to the desired tape. The microprocessor accesses the memory unit 22 to determine the rental price of the tape contained in the selected bin. The microprocessor then displays bin number and the rental price for the tape. The customer is asked if the selection is desired. If the customer enters "no" on the key pad 26, the transaction is canceled and the system returns to the initial configuration. If the customer enters "yes", the microprocessor allows the customer to select one more tape for rental in the same manner. It is possible that the system can be configured to allow rental of more than two tapes at any one time, but renting a maximum of two tapes minimizes the memory capacity necessary to operate the machine and minimizes the financial loss of unreturned tapes.

After the customer has entered information for one or two tapes, the microprocessor 20 searches a 30-day memory file to determine whether or not the customer's credit card balance has been checked in the last thirty days. Though it will not occur when the customer first purchases the customer card, if the customer's identification number includes a code indicating the customer's credit has not been checked in the last 30 days, the microprocessor must access the customer's credit card data base to obtain authorization for the purchase or rental. If the amount is authorized, the customer file is updated with a new 30-day check time for rechecking the customers credit account. The microprocessor then enables the bin module controller 44 to actuate the solenoids corresponding to the selected bins. A message is displayed on the message display 30 requesting the customer to remove the tape and close the door corresponding to the selected bin number. When the bin sensor corresponding to the selected bin indicates that the tape has been removed, the sensor determines whether or not the door has been closed. This sequence is repeated for each bin to be accessed by the customer. Once all the selected tapes have been removed, the microprocessor calculates the charges to be applied against the customer's credit amount and stores the entire transaction in the transaction file of the memory unit 22. The time and date of the transaction are entered along with the customer identification number, the dollar amount, the product identification number and the bank or other financial authorization number. The microprocessor then displays the amount of credit remaining on the customer's account. The microprocessor also outputs record information to the printer 28 for issuing a receipt to the customer.

In order to return one or both of the tapes, the customer passes his customer card through the card reader 24. (If the customer passes a card through the card reader different from the card used to rent the tapes and then enters the "return selection", the microprocessor produces a message asking the customer to use the same card as was used for the previous rental.) If the customer enters the return key (RN) on the key pad 26, the customer is asked to enter the number of tapes that are being returned and then requested to place one tape in the tape slot 32. The microprocessor enables the bar code reader 34 to scan the bar code information on the tape. Alternatively, the customer may enter the bar code number on the key pad. If the bar code is not recognized, the customer is advised to contact an appropriate person to resolve the problem. If the bar code is recognized, the microprocessor compares the current date to the date on which the tape was rented. If the tape is past due, a message is displayed indicating that the tape is past due and that the customer was charged for a "sale". The machine then displays the customer's current credit balance. If the tape is returned within the required time period, the microprocessor 20, through the bin module controller 44, activates the solenoid corresponding to any available bin. The tape is placed in the bin according to the required configuration and the customer then closes the door. The bin sensor 16 senses the tape in the bin and the closed door and the customer's account is decremented an appropriate amount according to the length of time the tape was rented. If the customer is returning two tapes, this process is repeated once again. If no further transactions are to be done, a receipt is issued from the printer 28 for the customer. The transaction data are stored. If the customer desires further transactions, the above-described process can be repeated.

Where the customer uses an ATM card to initially gain access to the machine, the customer is requested to enter the personal identification number (PIN). An ATM card will be used to purchase a customer card but will not be used to rent cassettes. If the personal identification number entered is correct, the customer is asked to enter on the key pad 26 the amount requested to be debited on the customer's bank account and credited to the customer card account in the dispensing machine. Then a customer card will be issued to the customer and the customer can then follow the steps described above to purchase or rent cassettes. A receipt is then issued by the printer 22 for the customer's record.

Simultaneous with any customer transaction, the microprocessor 20 maintains a list of all cassette numbers, the number of times each product was rented, and an accumulated and subtotal of all transactions and dollar amounts corresponding to the transactions. The microprocessor also keeps track of the currency taken in through the currency module. This information can then be accessed by an operator on a routine basis for record keeping purposes.

An operator maintains the machine and insures that there is a supply of customer cards available for use. New customer cards added to the stack in the card dispenser are preferably coded to have a customer identification number sequential to those preceding cards. The operator could also reinitialize appropriate registers in memory, such as the total currency.

At regular intervals, the memory unit is tested to determine all customer accounts which are still outstanding and which need to be brought current by accessing the customer's bank or credit card company so that the customer is ultimately billed for the rentals or purchases. Each customer's account the machine is then adjusted accordingly. If the system is updated every 30 days, for example, a customer may have used up the credit balance corresponding to the customer's card. Rather than accessing the customer's bank card company or credit card company in order to obtain further authorization, before the end of the 30-day period, the microprocessor will request the customer to authorize an additional amount, which will be stored as a credit amount until the end of the present 30-day period. The additional amount will then be charged to the customers bank or credit card account according to the actual charges made by the customer. If the customer wants to return the club card, and obtain a refund of any amount remaining in the customer's account, this can be done through an operator or other appropriate agency who will then check the balance of the customer's account and the credit card number in the machine before refunding the balance. The old customer card may be discarded and the customer card code deleted from the memory unit.

In one embodiment of the invention, the customer card is intended to store only the minimum amount of information necessary to provide a unique identification for all the customers who would be using the machine from which the customer card was issued. The customer card can be used only on that machine. Though additional information can be stored on the customer card, it is preferred to have the additional information stored in the resident memory unit 22 in the machine rather than on the card. It is contemplated that the customer card will use anywhere from a three to six digit code, for example, to identify the customer.

In one form of the invention, the customer card is used only to rent video tapes while the customer's credit card is used for purchase.

The management company 52 can independently access the machine and all other machines like it. The management company would then obtain inventory data, sales data and other necessary data contained in the memory unit 22 in order to calculate sales, rental volume, lost rates, etc.

In one method of using the machine, remote access to a database is not necessary. As a result, telephone charges and access charges from financial institutions would not be incurred. In this arrangement, a customer approaches a proprietor of the store in which the machine 10 is and pays a lump sum (e.g. $50) in cash or by credit card. If the payment is by credit card, a charge slip may be filled out by the customer at that time. The proprietor then uses a machine master card to access the machine and open an account for the customer. The proprietor enters the lump sum amount on the key pad 26 and a customer card is used. Thereafter, the customer can use the customer card without having to rely on the proprietor until the customer's account runs down. Such an arrangement is also useful for one who has no credit card or bank card and must pay cash to gain access to the machine.

It should be noted that the above embodiments are preferred but others are foreseeable. The described embodiments of the invention are only considered to be preferred and illustrative of the inventive concept; the scope of the invention is not to be restricted to such embodiments. Various and numerous other arrangements may be devised by one skilled in the art without departing from the spirit and scope of the invention.

I claim:

1. A dispensing machine that can be accessed repeatedly by a card issued by the machine, the machine comprising:

storage means for holding and dispensing a plurality of products;

memory means for storing information including representations of credit amount information, customer identification code information and product location information;

processing means for accessing information in the memory means and for entering information in the memory means;

credit input means responsive to information from customer for transferring credit for the customer to the processing means for storage in the memory means;

character entry means responsive to actuation by a customer for producing representations of credit amount information desired by the customer and communicating the credit amount information representations to the processing means;

customer card dispensing means responsive to the processing means for dispensing a customer card; and customer card reading means coupled to the processing means for obtaining representations of information from the customer card and for communicating the representations to the processing means.

2. The dispensing machine as claimed in claim 1 wherein the storage means is adapted for holding and dispensing video tape cassettes.

3. The dispensing machine as claimed in claim 1 further comprising means for accepting and retaining tender for producing representations of a credit amount to be communicated to and stored in the memory means.

4. The dispensing machine as claimed in claim 1 wherein the credit input means comprises means for reading encoded credit card information carried by a personal credit card and communicating the personal credit card information to the processing means.

5. The dispensing machine as claimed in claim 4 further comprising credit authorization means for communicating the credit card information to a remote database and for determining whether the credit amount information desired by the customer is available from the remote database.

6. The dispensing machine as claimed in claim 5 wherein the credit authorization means comprises means for obtaining a credit authorization code for storage in the memory means.

7. The dispensing machine as claimed in claim 1 wherein the character entry means comprises a key pad for manually entering information to be used by the processing unit.

8. The dispensing machine as claimed in claim 1 wherein the memory means comprises representations of product codes.

9. The dispensing machine as claimed in claim 1 wherein the memory means includes means for recording a unique identification code for at least one customer card in the customer card dispensing means.

10. The dispensing machine claimed in claim 1 wherein the card dispensing means includes means for stacking thin cards.

11. The dispensing machine as claimed in claim 10 wherein the card dispensing means includes an ejector slide for expelling a card.

12. A dispensing machine that can be accessed repeatedly by a card issued by the machine, the machine comprising:

bins for holding and dispensing a plurality of video tape cassettes;

memory means for storing representations of bin numbers, identification codes, available customer credit, telephone numbers and tape rental data;

computer processor means for accessing information in the memory means and for entering information in the memory means;

credit card reader means responsive to information from a credit card used by a customer for transferring credit for the customer to the computer processor means for storage in the memory means;

key pad means responsive to actuation by a customer for entering representations of credit amount information and customer information to be processed by the computer processor means;

modem means for communicating the credit card information to a remote data base and for determining whether the credit card amount information desired by the customer is available from the remote database;

dispenser means for dispensing customer cards to customers under control of the computer processor means wherein each customer card dispensed from the dispenser means comprises a respective unique identification code; and customer card reading means coupled to the computer processor means for obtaining representations of information from the customer card and for communicating the representations to the computer processor means.

13. The dispensing machine as claimed in claim 12 further comprising a tender module for accepting tender from a customer and counting the tender to produce a total tender amount accepted and for communicating the total tender amount to the computer processor means.

14. The dispensing machine as claimed in claim 12 further comprising display means for displaying messages controlled by the computer processor means.

15. The dispensing machine as claimed in claim 12 further comprising bar code reader means for reading bar code information on a video tape cassette and for communicating the bar code information to the computer processor means.

16. A dispensing machine that can be accessed repeatedly by a card issued by the machine, the machine comprising:

bins for holding and dispensing respective video tape cassettes wherein each bin can hold only one video tape cassette;

memory means for storing information including product location in the bins, unique customer identification codes and available credit;

computer processor means for accessing information stored in the memory means and for controlling access to the bins;

currency module means for accepting currency from a customer, counting the total amount of currency accepted and communicating a representation of the total amount to the computer processor means;

key pad means for entering customer information into the machine and communicating the customer information to the computer processor means;

customer card storage and dispensing means under control of the computer processor means for dispensing a customer card to a customer upon request by the customer;

card reader means coupled to the computer processor means for obtaining a unique identification code from the customer card and communicating the code to the computer processor means; and bar code reader means for reading a bar code on a video tape cassette and communicating a representation of the bar code to the computer processor means.

* * * * *

UNITED STATES PATENT AND TRADEMARK OFFICE

CERTIFICATE OF CORRECTION

PATENT NO. : 4,884,212

DATED : November 28, 1989

INVENTOR(S) : Richard Stutsman

It is certified that error appears in the above-identified patent and that said Letters Patent is hereby corrected as shown below:

In column 1, line 68, after "prior devices" insert --which require use of credit cards, generally require a specific--.

In column 3, line 48, after "designed to be" insert --accessed for--.

In column 3, line 56, change "formation" to --information--.

In column 8, line 25, change "number" to --numbers--.

In column 11, line 58, after "personal" insert --credit--.

In column 12, line 68, after "displays" insert --the--.

In column 14, line 48, after "account" insert --in--.

In column 15, line 61, before "customer for transferring" insert --a--.

Signed and Sealed this

Twentieth Day of November, 1990

*Attest:*

*Attesting Officer*

HARRY F. MANBECK, JR.

*Commissioner of Patents and Trademarks*